United States Patent [19]

Takegawa et al.

[11] Patent Number: 5,050,643

[45] Date of Patent: Sep. 24, 1991

[54] ON LOOM SYSTEM FOR MENDING BROKEN WARP YARN

[75] Inventors: Yujiro Takegawa, Ishikawa; Souichi Nakai, Kanazawa, both of Japan

[73] Assignee: Tsudakoma Corp., Ishikawa, Japan

[21] Appl. No.: 473,151

[22] Filed: Jan. 31, 1990

[30] Foreign Application Priority Data

Feb. 2, 1989 [JP] Japan ..... 1-24673
Jun. 9, 1989 [JP] Japan ..... 1-147003

[51] Int. Cl.[5] ..... D03J 1/14

[52] U.S. Cl. ..... 139/1 R; 139/353; 139/192; 139/35

[58] Field of Search ..... 139/353, 291 C, 1 R, 139/354–357, 192, 35; 28/209

[56] References Cited

U.S. PATENT DOCUMENTS

| | | | |
|---|---|---|---|
| 3,990,732 | 11/1976 | Reichert | 28/211 |
| 4,569,543 | 2/1986 | Kohlen et al. | 28/211 X |
| 4,817,675 | 4/1989 | Dewaele et al. | 139/35 |
| 4,898,213 | 2/1990 | Takegawa | 139/353 X |
| 4,905,737 | 3/1990 | Gryson | 139/353 X |

FOREIGN PATENT DOCUMENTS

| | | |
|---|---|---|
| 29-17172 | 12/1954 | Japan . |
| 50-20067 | 3/1975 | Japan . |
| 62-69851 | 3/1987 | Japan . |
| 1-139846 | 6/1989 | Japan . |
| 1-174649 | 7/1989 | Japan . |
| 1-192853 | 8/1989 | Japan . |

*Primary Examiner*—Andrew M. Falik
*Attorney, Agent, or Firm*—Wenderoth, Lind & Ponack

[57] ABSTRACT

A method and apparatus for automatically mending warp yarn selects broken warp yarns from among a group of the warp yarns at the time of breakage of the warp yarn. The spacings between the reed wires of a reed through which the broken warp yarn is passed or the spacings between the adjoining reed wires are then enlarged. A yarn passing member is then positioned at the reed wires through which the broken warp yarn is passed on the basis of the position of the reed wires having large spacings therebetween. The yarn passing member is then inserted into space of the reed wires through which the broken warp yarn is passed. A mending yarn tied to the broken warp yarn is then passed and guided into corresponding reed wires by the yarn passing member. In such a manner, it is possible to then set the loom to be re-started.

2 Claims, 22 Drawing Sheets

ON LOOM SYSTEM FOR MENDING BROKEN WARP YARN

BACKGROUND OF THE INVENTION

1. Field of the Invention

The present invention relates to a method and apparatus for automatically mending warp yarn in which a mending yarn is tied to a broken warp yarn, and the mending yarn is passed through a heddle and a reed.

2. Prior Art

When a warp yarn is broken during weaving operation, a dropper device or the like generates a warp stop signal to stop the loom automatically. Then, an operator picks up or extracts the broken warp yarn from a series of parallel warp yarns, ties a mending yarn to the leading end of the broken warp yarn, passes the mending yarn through the heddle and the reed for thereby mending the broken yarn and sets the loom to be re-started. As mentioned just above, the conventional mending operation is carried out entirely by the manual operations of the operator.

The applicant proposed a method and apparatus for automatically mending warp yarn in Japanese Laid-Open Patent Publication No. 1-192853 to expedite the manual mending operation, which is however not completely automatized.

SUMMARY OF THE INVENTION

Accordingly, it is an object of the present invention to accurately position and insert a yarn passing member at and into reed wires of a reed through which the broken warp yarn is passed, and pass and guide a mending yarn tied to the leading end of the broken warp yarn into corresponding reed wires by the yarn passing member.

To achieve the above objects, a method and apparatus for automatically mending warp yarns according to the present invention comprises the steps of selecting broken warp yarns among the group of the warp yarns at the time of breakage of the warp yarn, enlarging the spacings between adjacent reed wires of a reed through which the broken warp yarn is passed or the spacings of the adjoining reed wires, positioning a yarn passing member at the reed wires through which the broken warp yarn is passed on the basis of the position of the reed wires having large spacings therebetween, inserting the yarn passing member into the space of the reed wires through which the broken warp yarn is passed, passing and guiding a mending yarn tied to the broken warp yarn into corresponding reed wires by the yarn passing member. In such a manner, it is possible to set the loom to be restarted.

The above and other objects and features and advantages of the present invention will become more apparent from the following description taken in conjunction with the accompanying drawings.

DESCRIPTION OF PREFERRED EMBODIMENT

A method and apparatus for automatically mending warp yarn according to a first embodiment of the present invention will be described with reference to FIGS. 1 to 13.

Figure 1:
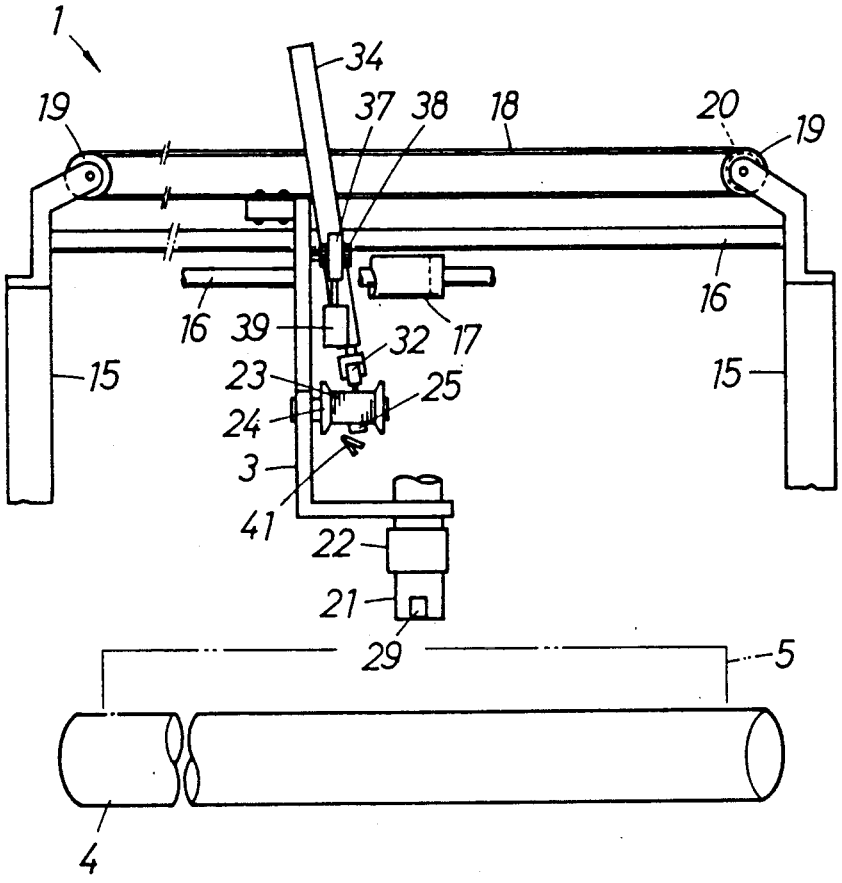
FIG. 1 is a front elevational view showing an automatic warp yarn mending device according to a first embodiment of the present invention.
Figure 2:
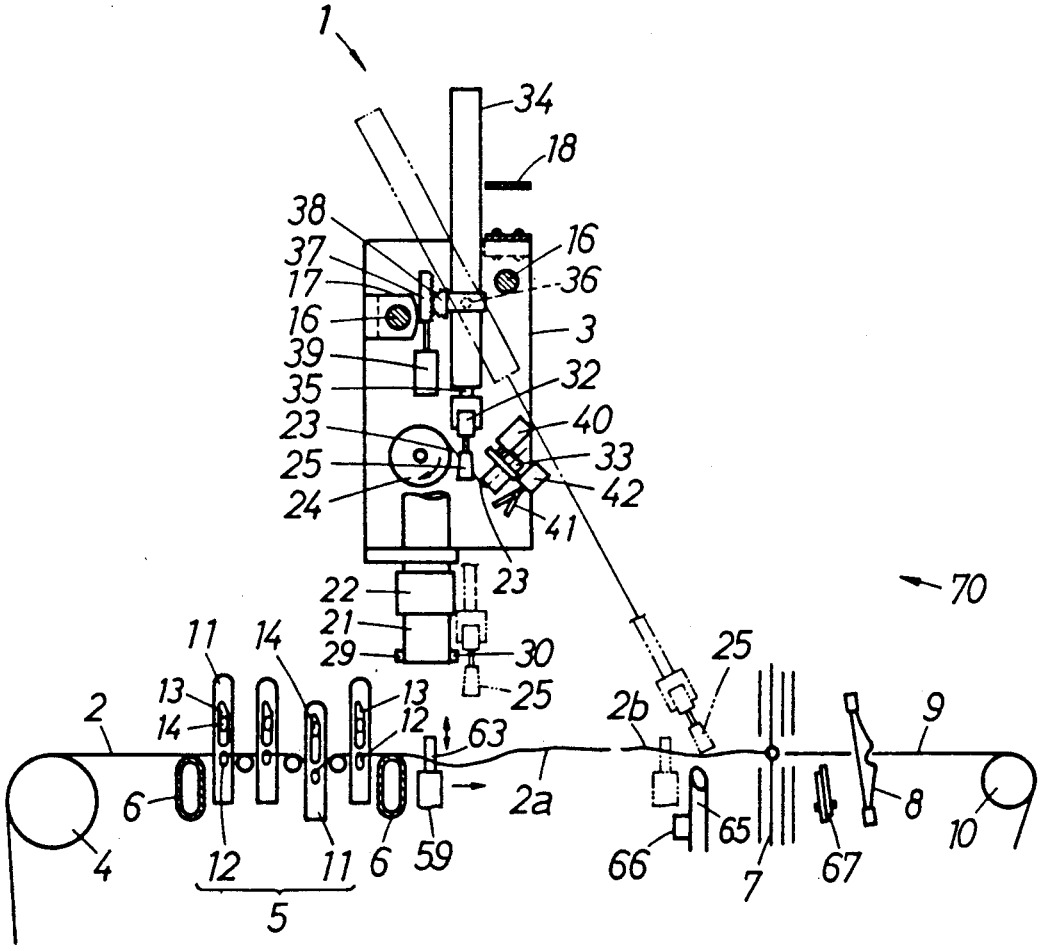
FIG. 2 is a side elevational view of the automatic warp yarn mending device of FIG. 1.

FIGS. 1 and 2 show an arrangement of an automatic warp yarn mending device for carrying out a method according to the first embodiment of the present invention.

The automatic warp yarn mending device 1 is positioned over a series of parallel warp yarns 2 and incorporated in a bracket 3 movable in the direction of the width of the loom. The series of parallel warp yarns 2 are sheet shaped, and contact a tension roller 4, a dropper device 5 and a guide 6 and pass through a heddle 7 and a reed 8. The warp yarns 2 then cross weft yarns to be formed as a woven fabric 9 and reach a take-up roller 10. Droppers 11 of the dropper device 5 are supported by the warp yarn 2 at passing holes 12 thereof and cross an electrode bar 14 at holding holes 13 thereof.

The bracket 3 is positioned between a left frame 15 and a right frame 15 and supported by a slider 17 movably in the direction of the width relative to the two guide rails 16 which extend widthwise of the loom and are in parallel with each other. The bracket 3 is connected to a part of an endless drive belt 18. The endless drive belt 18 is entrained around a pair of pulleys 19 which are, supported by the left and the right side frames 15, and are capable of being driven by a position control motor 20.

The bracket 3 has a clamper 25, and a cutter 41 as well as a suction pipe 21, a knotter 22 and a mending yarn bobbin 24 on which the mending yarn is wound. The suction pipe 21 is attached to the bracket 3 at a position which is higher than the droppers 11 and has an opening opened downward and incorporated into the knotter 21 at the middle portion thereof. Two yarn sensors 29, 30 are provided at the opening of the suction pipe 21. The knotter 22 is constituted as a mechanical type for tying yarns mechanically, an air flow type for tying the yarns using air, or an adhesive type for tying the yarns using adhesives. The mending yarn bobbin 24 is positioned, for example, at a position which is higher than the suction pipe 21 and rotatably supported by the bracket 3. One end of the mending yarn 23 is held by a clamper 25 which is operated by a solenoid 32 and positioned inside a suction pipe 33. The clamper 25 as well as the solenoid 32 is supported by a piston rod 35 of a pneumatic cylinder 34. The pneumatic cylinder 34 is rotatably supported by a pin 36 relative to the bracket 3 and rotatable by a rack 37, a pinion 38 and a pneumatic cylinder 39. The suction pipe 33 is supported to be movable aslant by pneumatic cylinder 40 at the side of the bracket 3. A cutter 41 is supported by the bracket 3 at the position adjacent to the suction pipe 33 and is actuatable by a cutter drive device 42.

A suction pipe 65 and a sensor 66 attached to the suction pipe 65 are respectively provided under the clamper 25 where the clamper 25 is positioned at the advancing position thereof after the pneumatic cylinder 34 is turned by the rack 37 and pinion 38. A cutter 67 is provided at the rear side of the reed 8.

Figure 3:
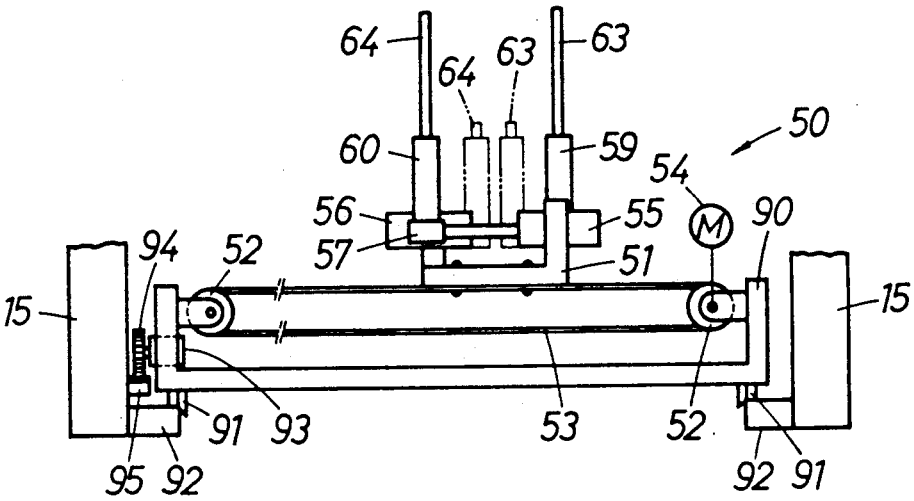
FIG. 3 is a front elevational view showing a heddle selecting device.
Figure 4:
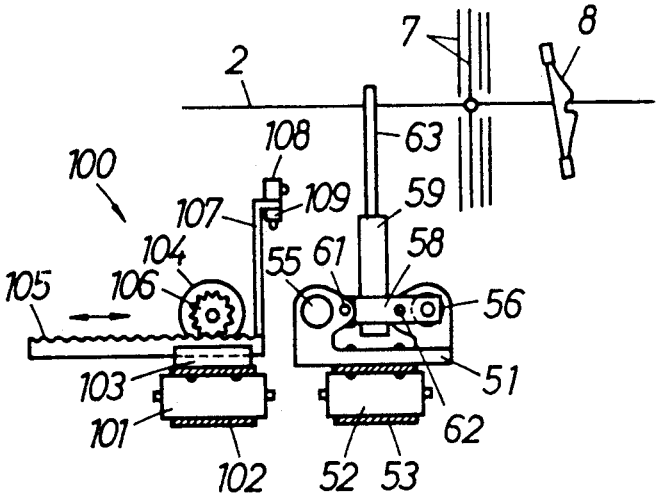
FIG. 4 is a side elevational view showing a main portion of the heddle selecting device.

FIGS. 3 and 4 illustrate an arrangement of a heddle selecting device 50.

The heddle selecting device 50 is positioned between the heddle 7 and the dropper device 5 under the warp yarn 2 and movable in the direction of the warp yarn 2 and width direction of the loom as illustrated in FIG. 3 and incorporated in a bracket 51. The bracket 51 is supported on an endless belt 53 and movable in the width direction of the loom by a pair of pulleys 52 supported by brackets 90, an endless belt 53 entrained around the pulleys 52, and a drive motor 54 for rotating the pulley 52 at the drive side. The bracket 51 has horizontal pneumatic cylinders 55, 56 at both ends of the widthwise direction of the loom which respectively hold holders 57, 58 at the tip ends thereof movably in the widthwise direction of the loom. The holders 57, 58 are guided by guide rods 61, 62 attached to the bracket 51 and supported so that the holders 57, 58 are not rotatable about the cylinder rods of the pneumatic cylinders 55, 56. The holders 57, 58 hold the selecting members 63, 64 which are vertically movable by the piston rods of vertically arranged pneumatic cylinders 59, 60.

The bracket 90 is movable in the direction of the warp yarn 2 by left and right wheels 91 which are movable on rails 92 attached to the frames 15, a motor 93 attached to the bracket 90, a pinion 94 to be driven by the motor 93, and a rack 95 attached to the frames 15.

The suction pipe 65 and the cutter 67 are attached to an endless belt and movable in the direction of the width of the loom in the same manner as the heddle selecting device 50. The endless belt is entrained around a pair of pulleys, which are driven by a drive motor (not shown).

Figure 5:
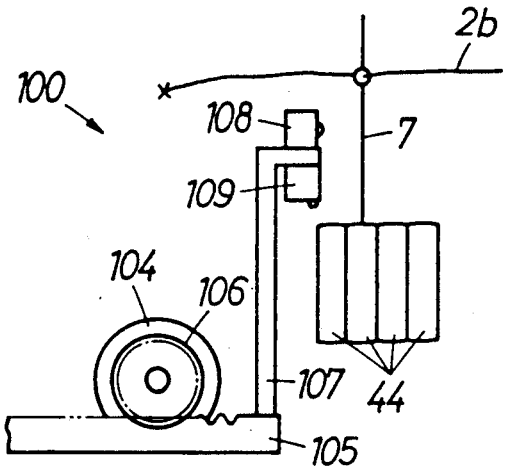
FIG. 5 is a side elevational view showing a heddle detecting device.
Figure 6:
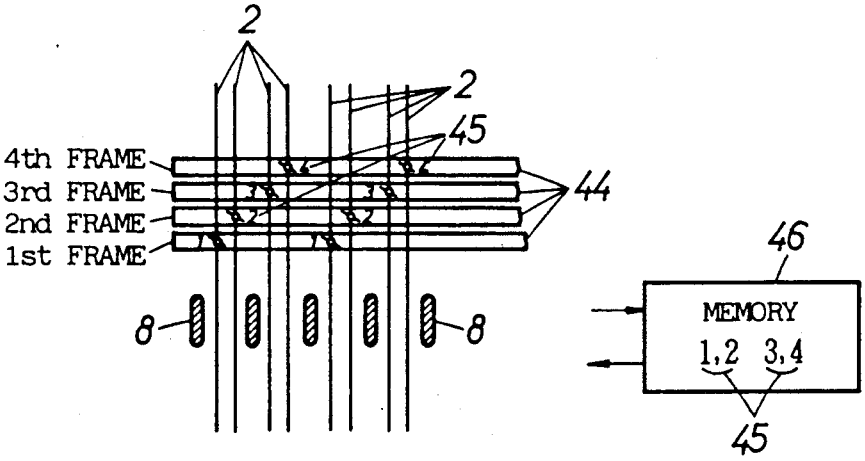
FIG. 6 is a plan view showing frames of the heddle.

The bracket 90 has a heddle detecting device 100 for detecting an identification code of the heddle 7 through which the broken wary yarn is passed. The heddle detecting device 100 is supported on an endless belt 102 which is entrained around a pair of pulleys 101 to be driven by a drive motor (not shown) so that the heddle detecting device 100 can move in the direction of width of the loom as illustrated in FIGS. 4 and 5 in the same manner of the heddle selecting device 50. The heddle detecting device 100 is provided with a rack 105 slidably movable on a guide 103 extending in parallel with the warp yarn 2. The rack 105 is movable in the direction of the warp yarn 2 by a pinion 106 of a motor 104 and has a tip end holder 107 provided with a horizontal sensor 108 over the tip end holder 107 and a downward sensor 109 under the tip end holder 107. The horizontal sensor 108 is provided to detect the heddle 7 of the heddle frame 44 and the downward sensor 109 is provided to specify one of the frames among a plurality of heddle frames. According to the first embodiment, four heddle frames are illustrated. That is, four heddle frames 44, as illustrated in FIG. 6, are arranged in the direction of the warp yarns 2. Each heddle frame holds four warp yarns successively. With the repetition of such holding operations, all the warp yarns 2 are held by the heddle frames. The warp yarns 2 are supported by the heddle 7 and passed through the reed wires every two warp yarns. Accordingly, two warp yarns passed through the reed wires have a fixed relationship with numbers of the heddle frames 44 supporting the warp yarns 2. The members through which the warp yarns 2 are passed, for example, the heddle 7 are given an inherent identification code number 45 corresponding to the number of the heddle frame 44 for supporting the heddle 7. An identification code 45 is stored in a memory 46 for every warp yarn 2 passed through the same reed wires.

Figure 7:
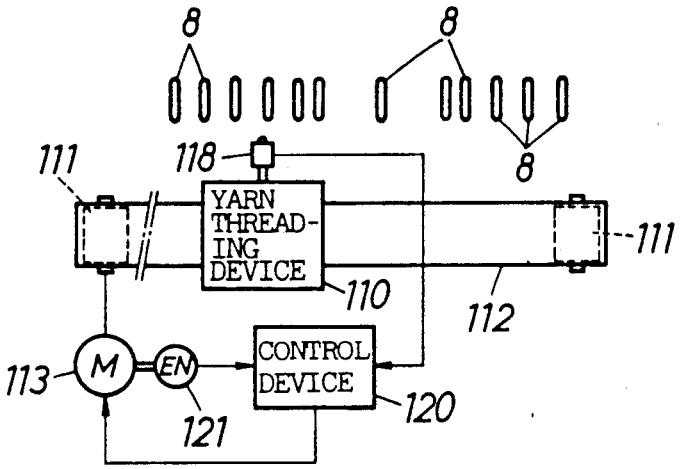
FIG. 7 is a plan view showing a yarn passing device.
Figure 8:
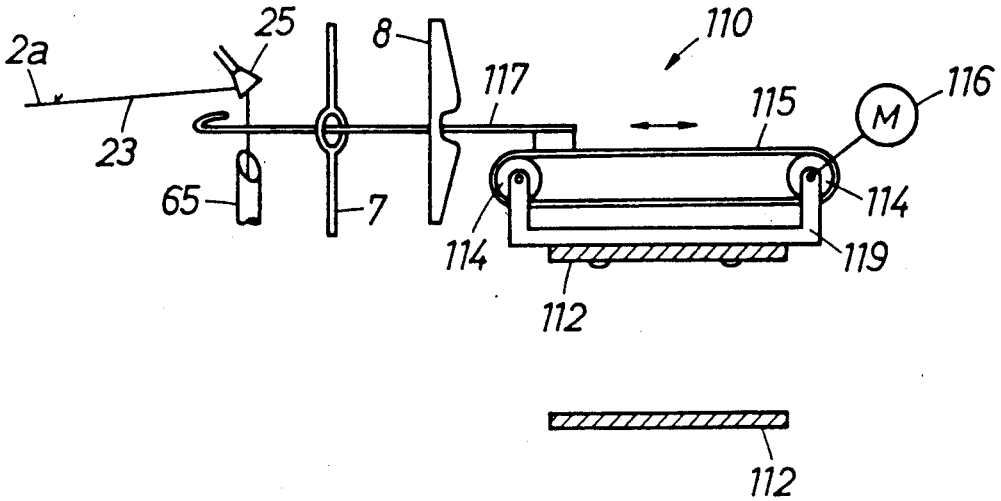
FIG. 8 is a side elevational view of FIG. 7.

FIGS. 7 and 8 illustrate a yarn passing or threading device 110. The yarn passing device 110 is supported to be movable in the direction of the width of the loom by a belt 112 entrained around a pair of pulleys 111 which is rotatably attached to frames 15 in the same manner as the heddle selecting device 50. The yarn passing device 10 is moved for a predetermined interval by the rotation of the motor 113 and is stopped upon reception of a signal issued by a sensor 118 indicative of the reed wires opposed to the reed 8 and having reed wires with large spacers therebetween. The motor 113 is controlled by a control device 120 and a speed of rotation of the motor 113 is detected by an encoder 121. The yarn passing device 110 has a needle 117 provided with a hook for drawing the mending yarn 23. The needle 117 is held by a timing pulley 114 and a timing belt 115 so as to be moved in the direction of the warp yarn 2. The timing pulley 114 and the timing belt 115 are supported by the belt 112 and are advanced or retracted by a motor 116.

Figure 9:
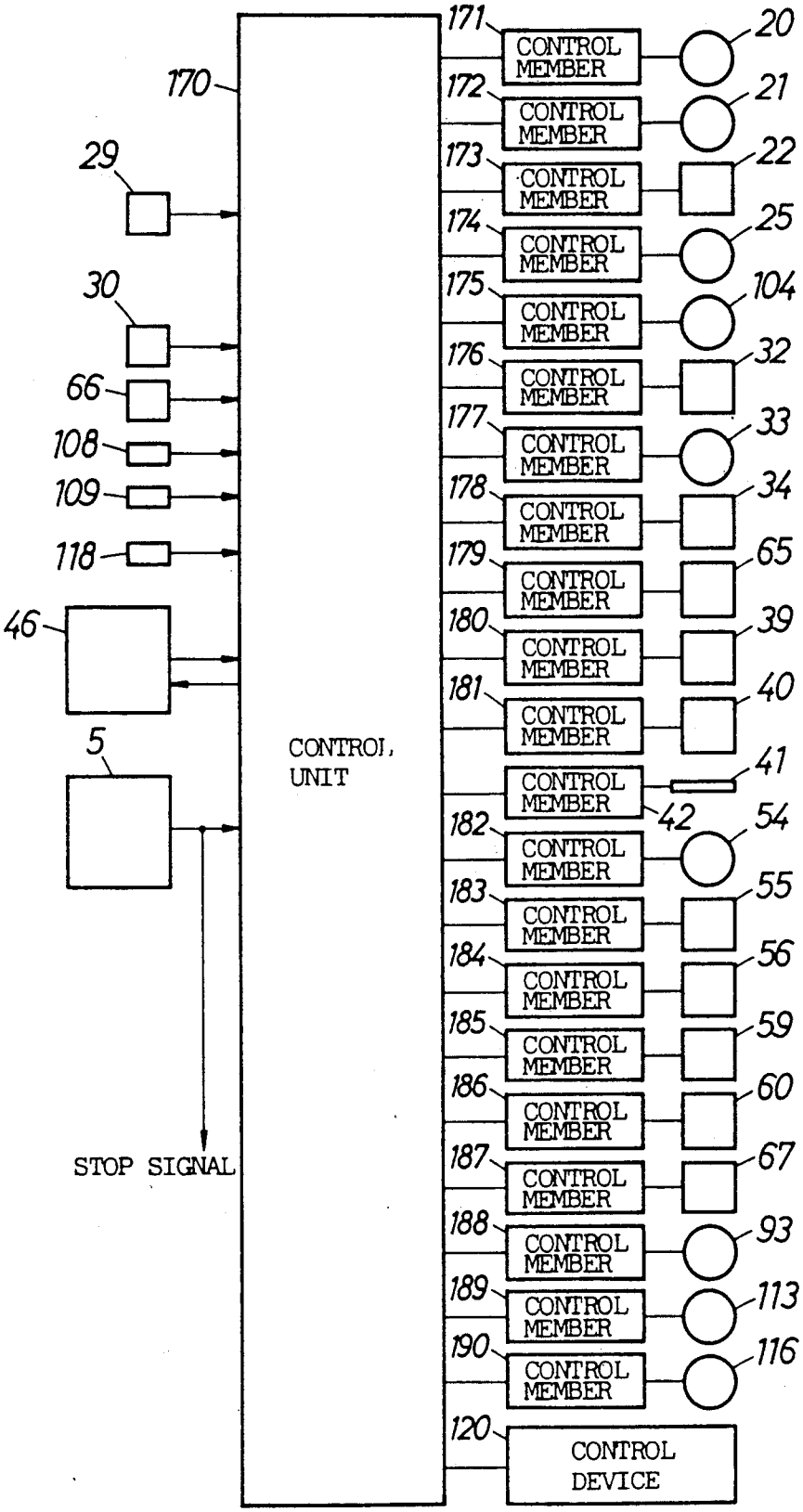
FIG. 9 is a block diagram of assistance in explaining connecting relationship between a control device and other operation members.

FIG. 9 shows a block diagram of assistance in explaining an electric connecting relationship between a control unit 170 and other operation members. The control unit 170 is provided with a program to carry out the method according to the first embodiment of the present invention. The control unit 170 is connected to the dropper device 5, the yarn sensors 29, 30 at the input side thereof, and to control members 171, 172 . . . 190 for controlling the position control motor 20, the suction pipe 21, the knotter 22 at the output side thereof. The control members 171, 172 . . . 190 are assembled, depending on the object to be controlled, as members to control the speed of rotation of the motors, turn a source of air under pressure or switches on or of or turn a solenoid on or off.

The automatic warp yarn mending device 1 is controlled by the control unit 170. Hence the control unit 170 stores therein the program required for a series of operations on the basis of the method for automatically mending the warp yarn. The series of operations stored in the control unit 170 are executed in accordance with the steps illustrated in the flowchart of FIGS. 10(*a*), 10(*b*), 10(*c*).

When the warp yarn 2 is broken during the weaving operation, the droppers 11 at the position corresponding to the broken warp yarns 2*a*, 2*b* are dropped as illustrated in FIGS. 2 and 11(*a*) and contact the electrode 14 whereby the dropper device 5 issues an electric warp yarn stop signal and supplies the warp yarn stop signal to the control system of the loom Hence the loom is topped to rotate to an appropriate stopping angle of the next picking cycle.

When the rotation of the loom is stopped, an automatic warp yarn end extracting device as disclosed in Japanese Laid-Open Patent Publication No. 62-69851 automatically detects the position of the dropper 11 which is dropped while it is moved, and thereafter advances and retracts the dropper 11 in the widthwise direction of the loom while it is gripped. Then, the device displaces the normal warp yarn adjacent to the broken warp yarns 2*a*, 2*b* in the direction of the picking end side for thereby forming spaces at the portions of the broken warp yarns 2*a*, 2*b* and sets the broken warp yarn 2 in order to be extracted with ease and extracts the broken warp yarn 2 from among the plurality of warp yarns 2.

Figure 10:
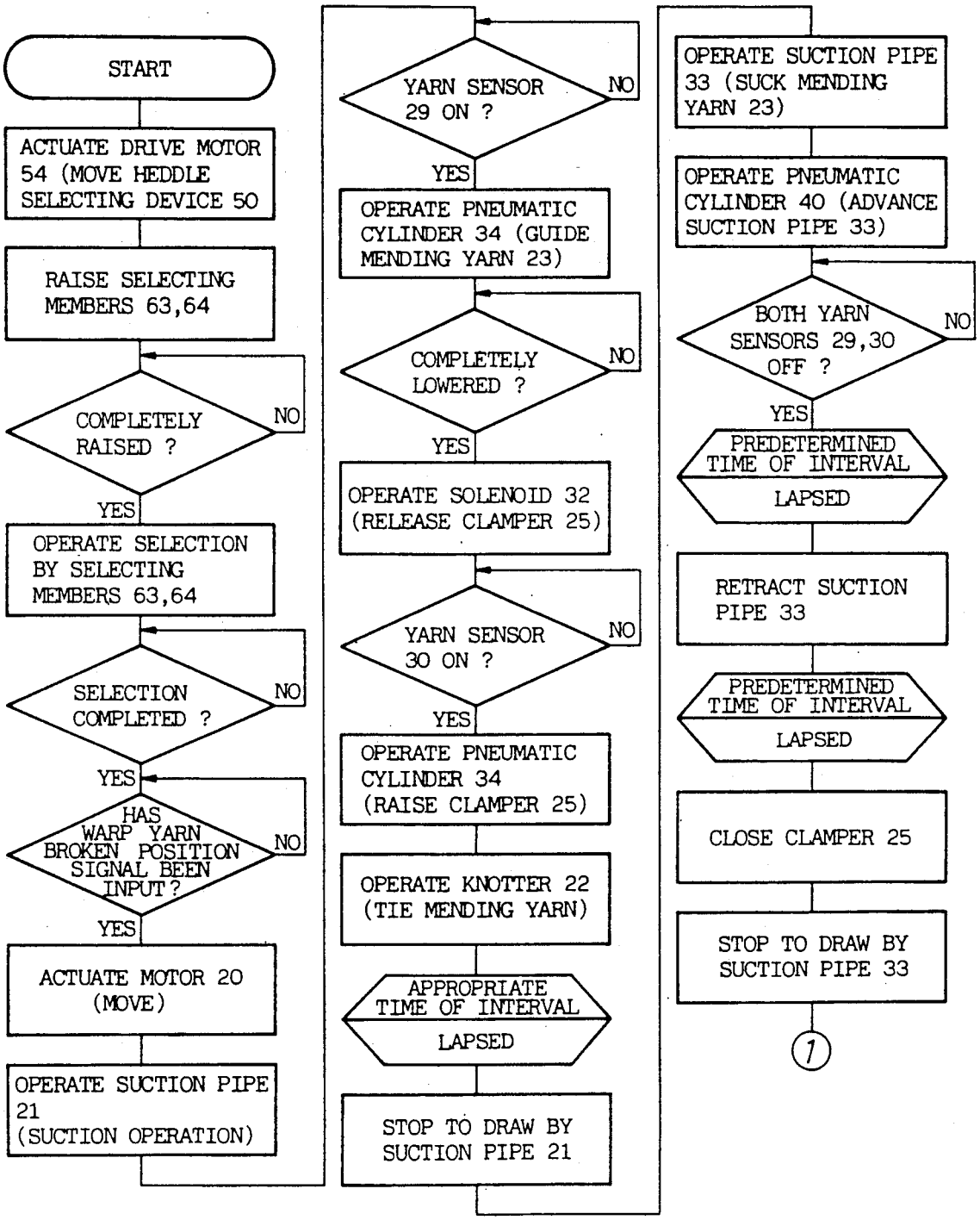
FIGS. 10(*a*) to 10 (*c*) together comprise a flowchart showing a series of processes for automatically mending warp yarn.
Figure 10B:
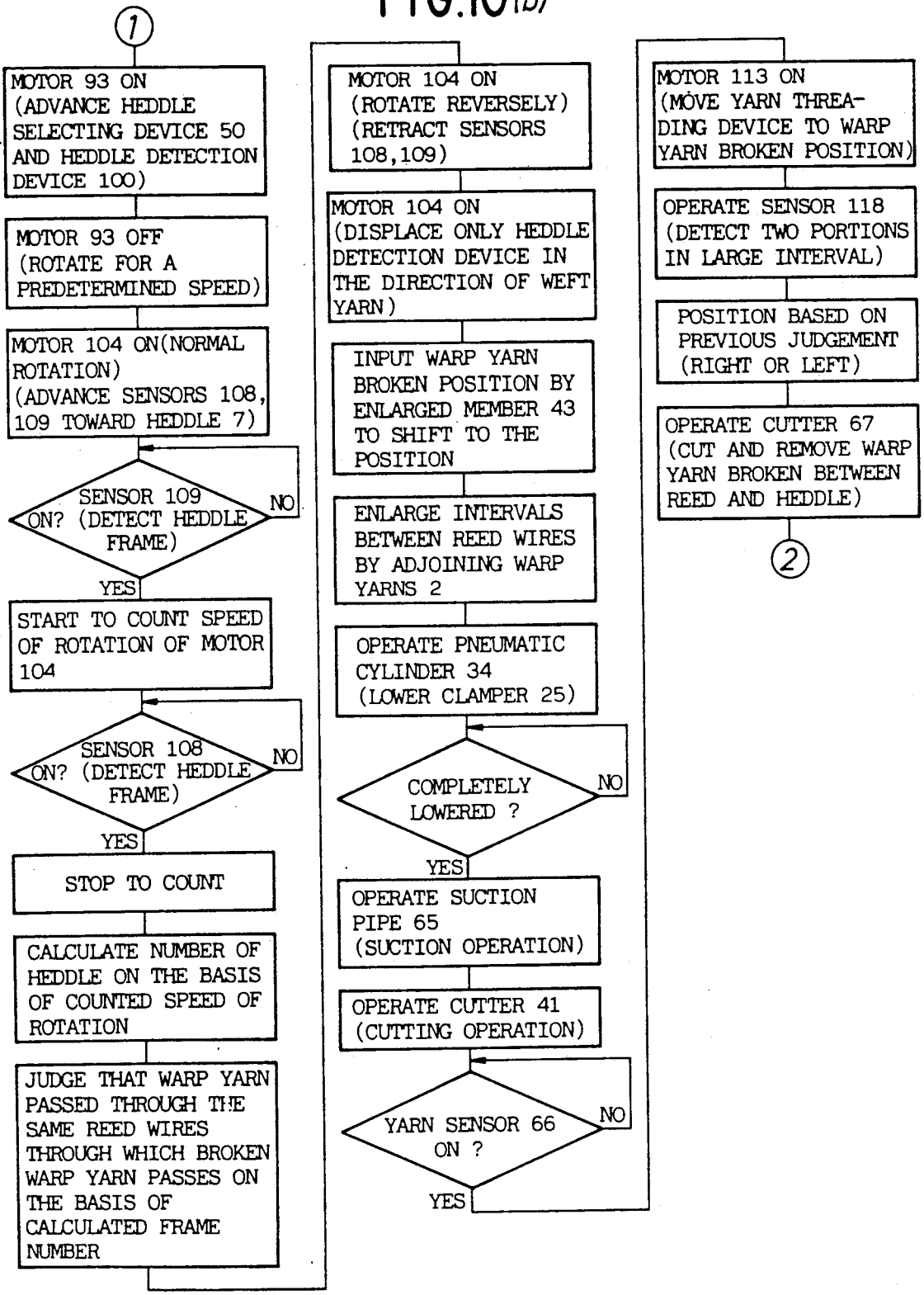
Figure 10:
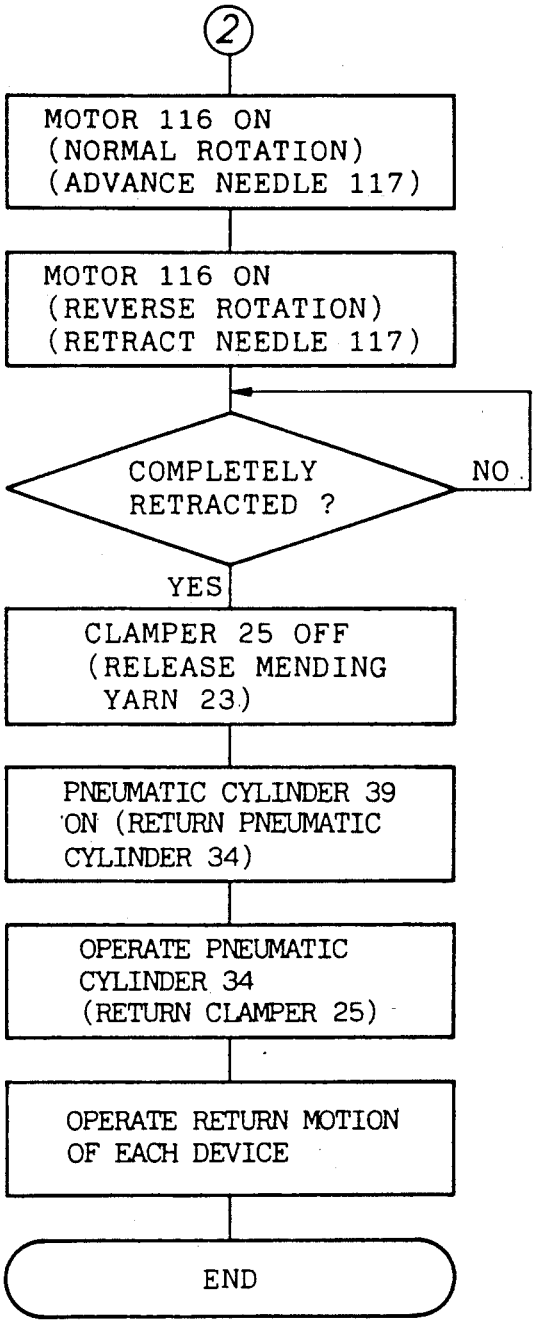
Figure 11A:
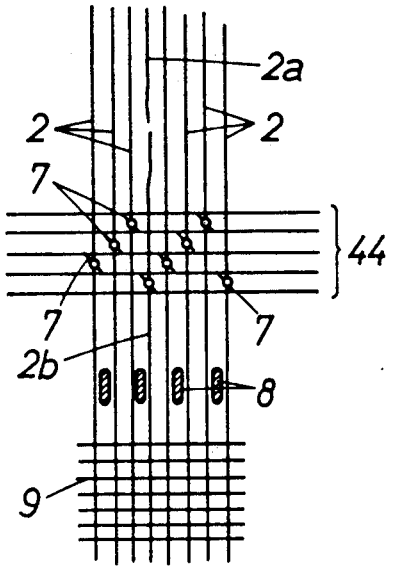
FIGS. 11 (*a*) to 11(*d*) are plan views of assistance in explaining operations for selecting the heddle.
Figure 11B:
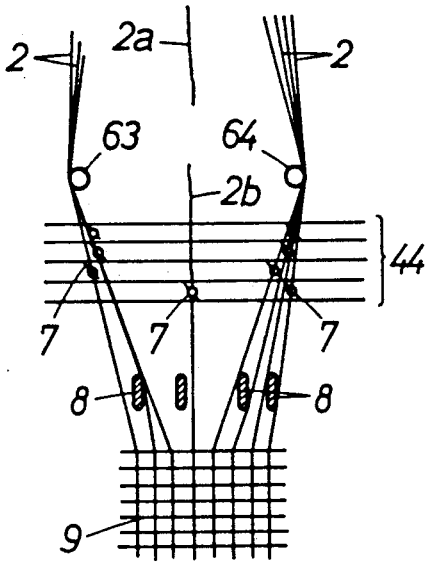
Figure 11C:
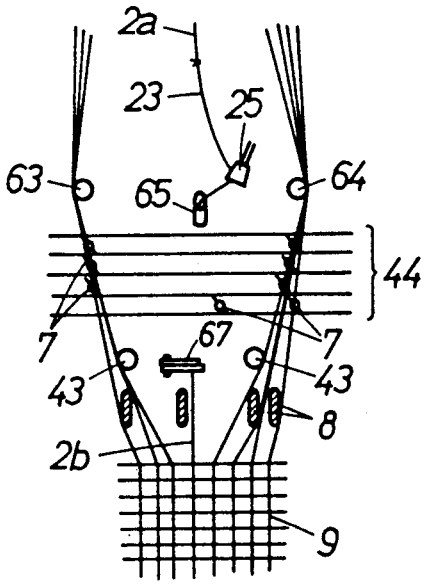
Figure 11D:
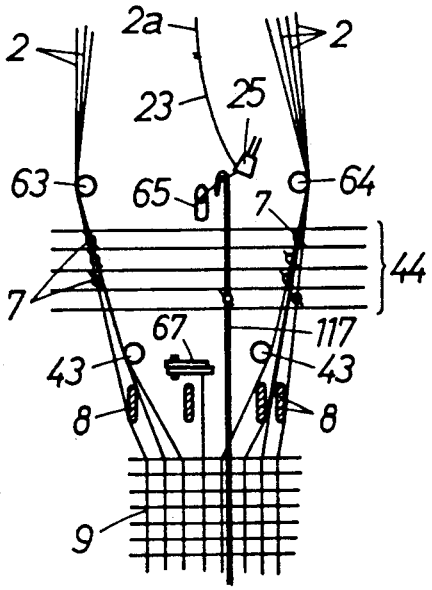

Thereafter, the control unit 170 starts to execute the program steps illustrated in FIGS. 10(*a*) to 10(*c*).

The control unit 170 receives the warp yarn broken signal from the automatic broken warp yarn end extracting device or the known broken warp yarn detecting device, and operates the drive motor 54 by the control member 182 to thereby move the heddle selecting device 50 to the position where the dropper 11 is dropped. Thereafter, the selecting members 63, 64 are raised between the two warp yarns adjoining the left and the right of the broken warp yarns 2 by the operation of control members 185, 186 and the pneumatic cylinders 59, 60. Inasmuch as the heddle selecting device 50 is positioned at the side of the dropper 11, it can be inserted with ease into the warp yarns 2 which are displaced by the extraction of the previously broken warp yarn 2*a*. The selecting members 63, 64 at the raising state are moved away from each other by the control members 183, 184 and the pneumatic cylinders 55, 56 as illustrated in FIG. 11(*b*). Consequently, the dropper 11 inserting into the normal warp yarns 2, the heddle 7 and the reed wires move away from the broken warp yarns 2*a*, 2*b* so that the ends of the broken warp yarns 2*a*, 2*b* are set to be extracted with ease.

At this time, the heddle detecting device 100 is moved to the position of the dropper in a dropping state by rotary motion of a pair of pulleys 101 driven by a drive motor (not shown) in the same manner as the heddle selecting device 50.

Figure 12:
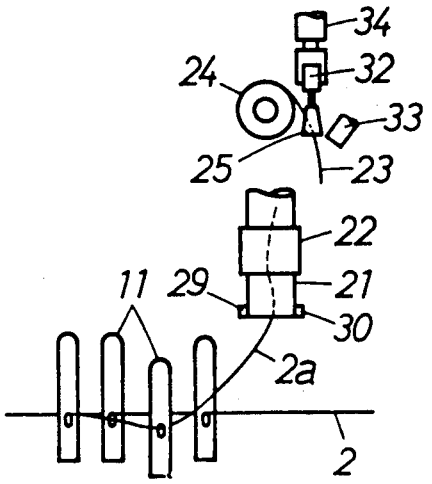
FIGS. 12(*a*) to 12(*f*) are views side elevational views of assistance in explaining operations for automatically mending warp yarn.
Figure 12:
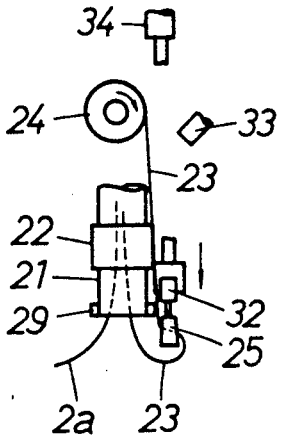
Figure 12:
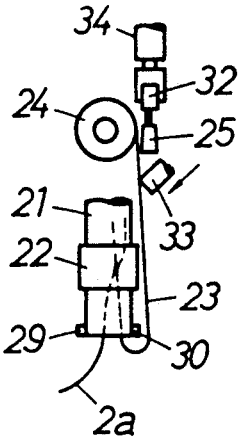
Figure 12:
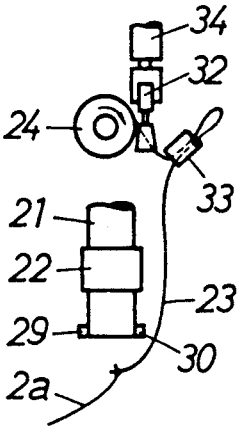
Figure 12:
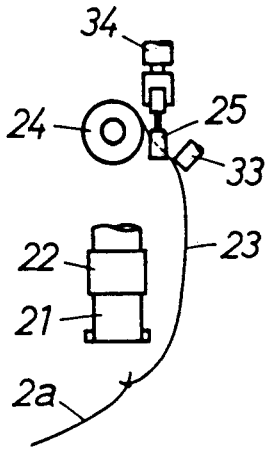
Figure 12:
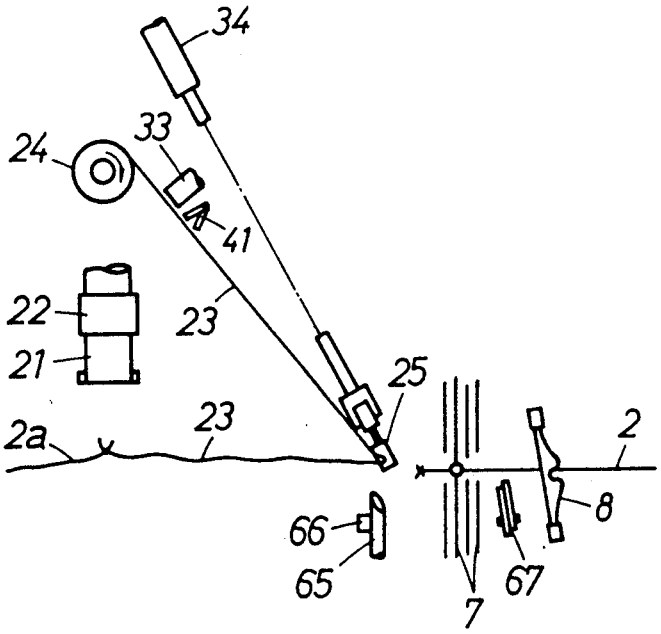

Upon completion of the selecting process, the controller 170 confirms the reception of the warp yarn broken signal and then operates the position control motor 20 to control the speed of rotation of the motor 20 by the control member 171 whereby the bracket 3 is moved from the stand-by position of the picking end side to the position of the dropper 11 in a dropping state. Thereafter, the suction pipe 21 is allowed to correspond to the end of the broken warp yarn 2*a* which is in the extracting state and the control member 172 is set to be ON state to generate an air current in the drawing direction within the suction pipe 21 so that the drawing operation is started. The end of the broken warp yarn 2*a* is inserted into the suction pipe 21 by the air current as illustrated in FIG. 12(*a*) and reaches a predetermined position of the knotter 22. This state is detected by the yarn sensor 29 during its ON state and is fed to the control unit 170 as an instruction to proceed to the next step. The suction pipe 21 may be arranged to be vertically raised or lowered by the actuator in which the suction pipe 21 is lowered at the suction time to directly draw the broken warp yarn which is easily extractable by the automatic warp yarn end extracting device.

The control unit 170 lowers the clamper 25 in a raising state by the pneumatic cylinder 34 which moves substantially vertically by the operation of the control member 178 whereby the mending yarn 23 is extracted from the mending yarn bobbin 24 to thereby move the mending yarn 23 to the portion adjacent to the opening of the suction pipe 21. Upon confirmation of lowering of the clamper 25, the solenoid 32 is actuated by a control member 176 for setting the clamper 25 in a released state. At this time, the end of the mending yarn 23 is guided, in the same fashion as that of the end of the broken warp yarn 2*a*, by the air current of the suction pipe 21 into a predetermined position of the knotter 22. This state is confirmed by the yarn sensor 30 during its ON state and is fed to the control unit 170 as the signal to proceed to the next step.

The control unit 170, after raising the clamper 25 by the control member 178 and the pneumatic cylinder 34, operates the control member 173 and the knotter 22 for setting the end of the broken warp yarn 2*a* and the end of the mending yarn 23 to be tied as illustrated in FIG. 12(*c*).

The control unit 170, after the passage of the appropriate time of interval, stops the suction operation by the suction pipe 21 but operates the suction pipe 33 by the control member 177 instead of the suction pipe 21. Thereafter, the control unit 170 advances the suction pipe 33 from its retracted position by the pneumatic cylinder 40 and its control member 181 so that the mending yarn 23 is drawn at its middle and held by the suction pipe 33 with the aid of the air current in the suction direction as illustrated in FIGS. 12(*c*), 12(*d*). At the same time, since the air current is not generated in the suction pipe 21, the broken warp yarn 2*a* and the mending yarn 23 which are in a state to be tied are naturally dropped by gravity and fly out from the inside of the suction pipe 21. This state is confirmed by both the yarn sensors 29, 30 during their OFF states.

The control unit 170 retracts the suction pipe 33 upon confirmation of this state and closes the clamper 25 for holding the mending yarn 23 again between the mending yarn bobbin 24 and the suction pipe 33 after passage of a predetermined time interval, then stops the suction operation by the suction pipe 33.

Successively, the motor 93 is turned on when the heddle selecting device 50 and the heddle detecting device 100 advance toward the broken warp yarn 2a. The motor 93 is turned after a while, the heddle selecting device 50 and the heddle detecting device 100 stop after moving a predetermined interval.

At this time, inasmuch as the selecting members 63, 64 are moved to the portion adjacent to the heddle 7 while they are raised, both the spacings between the heddle 7 at the side of the broken warp yarn 2a and the heddle 7 at the side of the broken warp yarn 2b and the spacings between the reed wires adjoining the broken warp yarns 2a, 2b are enlarged. Next, a motor 104 is turned on to rotate normally so that both the sensors 108, 109 advance in the direction of the heddle 7. When a motor 109 is turned on during this advancing operation, the control unit 170 detects that the sensor 109 reaches the first heddle frame 44 whereby the control unit 170 starts counting for detecting the speed of rotation of the motor 104. When the sensor 108 is turned on thereafter, the control unit 170 detects the heddle 7 and stops counting and calculates the frame number of the heddle frame 44 from the detected speed of rotation of the motor. Thereafter, the control unit 170 turns on the motor in the reverse direction and retracts the sensors 108, 109, then turns on a drive motor (not shown) as needed so that only the heddle detection device 100 is displaced in the direction of the width of the loom. Thereafter, the control unit 170 receives the position of the broken warp yarns 2a, 2b to move a pair of enlarging members 43 provided between the heddle 7 and the reed 8 to the position of the broken warp yarns 2a, 2b whereby the spacings between the reed wires are enlarged by the adjoining warp yarns 2. The pair of enlarging members 43 (not illustrated) are supported, for example, on the bracket 51 by the supporting mechanism such as the selecting members 63, 64.

The controller 170 then operates the pneumatic cylinder 39 by the control member 180 so that the linear motion of the cylinder rod of the pneumatic cylinder 39 is changed to a rotary motion of the pneumatic cylinder 34 by the rack 37 and the pinion 38, directs the clamper 25 to the side of the opening end of the suction pipe 65, then operates the pneumatic cylinder 34 to lower the clamper 25 together with the mending yarn 23 to the portion near the opening end of suction pipe 65 as illustrated in FIGS. 11(*c*) and 12(*f*). The controller 170 starts the suction operation by the suction pipe 65 after confirmation of the lowering of the suction pipe 65 or from the start of the lowering operation of the suction pipe 65, then operates the cutter driver 42 for cutting the mending yarn 23 between the mending yarn bobbin 24 and the clamper 25. An end of the cut mending yarn 23 is drawn into and held by the suction pipe 33. This state is detected by the sensor 66 at its ON state.

In such a manner, the end of the mending yarn 23 is positioned between the clamper 25 and the suction pipe 65. At this time, the mending yarn 23 having the length sufficiently extending from the suction pipe 65 to the cloth fell is drawn in the suction pipe 65.

Figure 13:
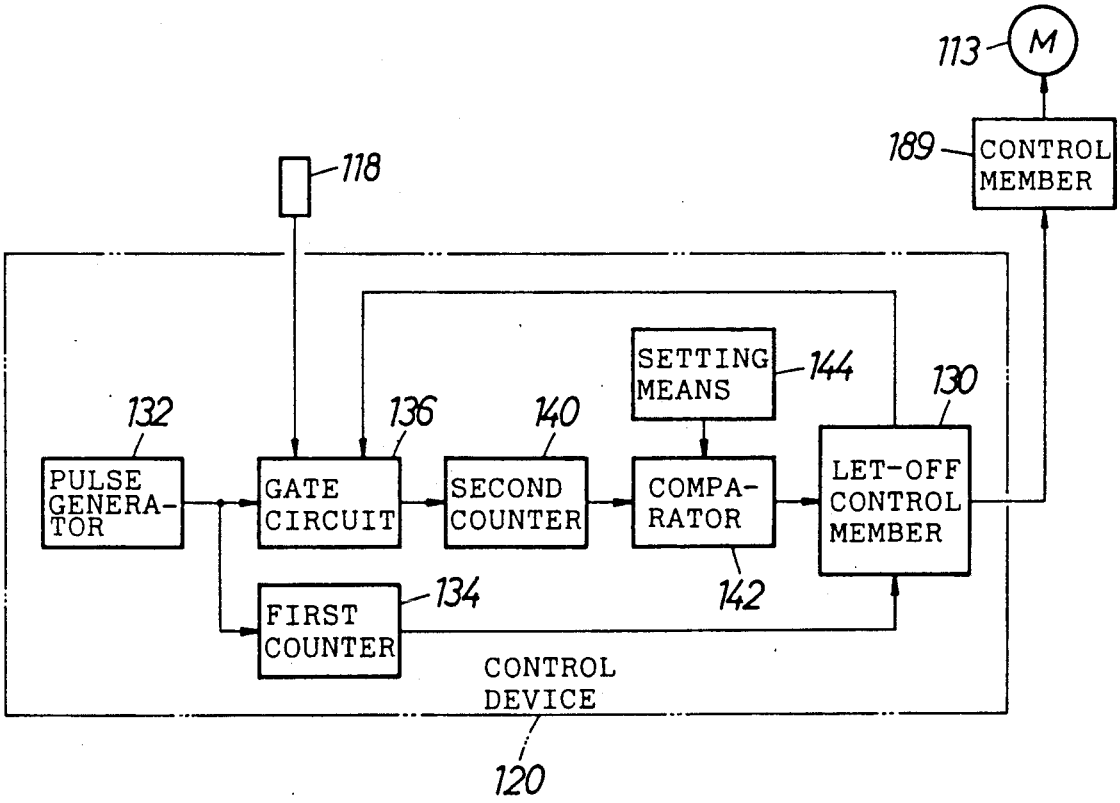
FIG. 13 is a block diagram of assistance in explaining a control device.

Thereafter, the controller 170 issues a start signal to the control device 120. The control device 120 comprises, as illustrated in FIG. 13, a let-off control member 130, a pulse generator 132, a first counter 134, a gate circuit 136, a second counter 140, a comparator 142 and a setting means 144. The let-off control member 130 receives the start signal and turns on the motor 113 through the control member 189 to thereby move the yarn passing device 110 in the direction of the width of the loom at a relatively high speed. At this time, the let-off control member 130 receives successively the pulse signal indicative of the rotational speed of the motor 113 output by the pulse generator through the first counter 134. The let-off control member 130 outputs on "H" level signal to the gate circuit 136 when the value counted by the first counter 134 reaches a predetermined value corresponding to the position slightly before the warp yarn broken position and sets the motor 113 to rotate at a low speed. The gate circuit 132 is turned on at the trailing edge of the detection signal output when the sensor 118 passes through the first reed wires and turned off at the leading edge of the detection signal output when the sensor 118 comes to the adjoining reed wires. A reference pulse output by the pulse generator 132 is supplied to the input terminal of the second counter 140 during the period of ON-OFF states of the gate circuit 132 set forth just above. The second counter 140 counts the number of pulses of the reference pulse to thereby measure the spacings between the reed wires and supplies the measured value to the comparator 142. Thereafter, the second counter 140 measures successively the spacings of the adjoining reed wires each time the sensor 118 passes through the reed wires and supplies the measured value to the comparator 142. The comparator 142 compares the measured value with the reference value set by the setting means 144 each time the comparator receives the measured value. When the measured value exceeds the reference value, the comparator 142 supplies the "H" level signal to the let-off control member 130. The let-off control member 130 receives and stores the value counted by the first counter 134, namely, the rotational speed of the motor each time the let-off motion receives the "H" level signal from the comparator 142. The let-off control member 130 stops the operation of the motor 113 upon reception of the "H" level signal two times from the comparator 142. Thereafter, the let-off control member 130 determines the spacings of the reed wires through which the broken warp yarns 2a, 2b are passed, upon reception of the condition executed by the control unit 170, and rotates the motor in the reverse direction so as to reach the stored rotational speed. In such a manner, it is possible to detect the large spacing of the reed wires between the two reed wires and identify the position of the reed wires through which the broken warp yarns 2a, 2b are passed with speed and accuracy on the basis of the condition executed by the control unit 170 and rotate the motor in the reverse direction at the rotational speed corresponding to the stored speed.

When the positioning of the yarn passing device 110 is completed, the control unit 170 operates the cutter 67 by the control member 187 so that the cutter 67 cuts the broken warp yarn 2b between the reed 8 and the heddle 7 and the cut broken yarn 2b is extracted. The speed of rotation of the motor 113, at the time of completion of the positioning of the yarn passing device 110, is used as the speed of rotation for positioning of the other devices.

Thereafter, the control unit 170 operates to rotate the motor 116 normally so that the needle 117 provided with the hook is advanced as illustrated in FIG. 11(*d*) and inserted into the through hole of the heddle 7 through the reed wires and thereafter operates to rotate the motor 116 in the reverse direction so that the needle 117 is retracted. The needle 117 provided with the hook is inserted into the through hole of the heddle 7 through the enlarged reed wires at its forward motion to hook the mending yarn 23 which is extended in the direction to cross the hook and holds the mending yarn 23 positioned between the clamper 25 and the suction pipe 65 in the V-shape and is retracted, whereby the needle 117 guides the mending yarn 23 between the through hole of the heddle 7 and the reed wires and completes the retraction.

Then, the suction pipe 65 stops the suction operation and the clamper 25 releases the mending yarn 23. Successively, the pneumatic cylinder 39 is operated and the pneumatic cylinder 34 is returned. Thereafter, the knotter 22, the heddle selecting device 50, the enlarging member 43, the heddle detecting device 100 and the yarn passing device 110 are also returned to complete the series of operations.

It is advisable to position the heddle linearly at the position of the reed wires for inserting the needle 117 provided with the hook. The device as disclosed in Japanese Laid-Open Patent Publication No. 50-20067 or Japanese Utility Model Publication No. 29-17172 can be applied to achieve this purpose. That is, the device set forth just above can be moved in the direction of the width of the loom by supporting it in the same manner as the heddle selecting device 50. It is possible to fixedly position the heddle 7 with a high accuracy if the device is operated upon completion of the positioning of the device by the rotation of the drive motor which is driven on the basis of the speed of rotation of the motor 113 which is supplied from the control device 12. The yarn threading device 110 may be provided at the front of the reed wires or at the rear portion of the heddle 7. The mending yarn 23 thus passed between the reed wires by the yarn passing device 110 and guided to the portion of adjacent to the cloth fell can be automatically processed until the loom is automatically restarted if the mending yarn 23 is processed by the device proposed by the applicant as disclosed in Japanese Laid-Open Patent Publication No. 1-139846.

It is required that the two warp yarns 2 passed into the same reed wires have regularity with each other relative to the number of the heddle frame 44. For this purpose, the identification code number 45, corresponding to the number of the heddle frame 44, is given to the heddle 7 which is the member to pass through the warp yarns 2. However, all the droppers 11 may be coded by utilizing the invention as disclosed in Japanese Laid-Open Patent Publication No. 1-174649 and the identification code 45 of the droppers 11 may be stored each time the warp yarns 2 are passed in the same reed wires whereby the identification code of the droppers 11 inserting the broken warp yarns **2*a*, 2*b* may be detected at the time of breakage of the warp yarn 2**.

Furthermore, although both the warps yarns 2 adjoining the broken warp yarns **2*a*, 2*b* are moved according to the first embodiment, it may be possible to make a condition to identify the warp yarn 2 passed through the same reed wires through which the warp yarns 2*a*, 2*b* are passed and to move only said warp yarn 2** to be positioned at the reed wires of the large intervals.

Furthermore, although the reed wires having large spacings can be detected by directly measuring the distance between the reed wires according to the first embodiment, it is not limited thereto. For example, the reed wires having large diameter can be detected by opposing the light emitting device with light receiving device in the direction of the width of the loom while the reed wires are intervened by the light emitting device and light receiving device, and moving both the light emitting device and the light receiving device while detecting the amount of light passed through the reed wires and comparing the detected amount of light with the predetermined value to see as to whether the former exceeds or does not exceeds the latter.

Although the heddle selecting device 50 is movable between the dropper device 5 and the heddle 7, it is not limited thereto. For example, a plurality of heddle selecting devices 50 may be provided to be fixed in the direction of the warp yarn 2. Inasmuch as some reed wires are liable to be enlarged depending on the kind of yarn and the fabric tissue, hence it is possible to position only one heddle selecting device 50 at an arbitrary position, preferably to provide it fixedly at the side of the dropper device 5.

Although the two warp yarns 2 are passed between the reed wires according to the present invention, but the present invention can be applied when more than three warp yarns 2 or one warp yarn 2 is passed through the reed wires.

In the case where only one warp yarn 2 is passed into the reed wires, a pair of selecting members 63, 64 enlarges at least one of the two normal warp yarns 2 adjoining the broken warp yarns **2*a*, 2*b* to thereby enlarge the spacings of at least one reed wire adjoining the reed wires through which the broken warp yarns 2*a*, 2*b* are passed. Thereafter, the enlarged reed wires are detected by the sensor 118. It is possible to specify the reed wires through which the broken warp yarns 2*a*, 2*b* are passed on the condition of the position of the adjoining warp yarns relative to the broken warp yarns 2*a*, 2*b* in the case one of the selecting members 63, 64 are moved and on the condition of the direction of the movement of the sensor 118 in the case both the selecting members 63, 64 are moved. Hence, it is possible to position the yarn passing device with a high accuracy as in the first embodiment. It is also possible to enlarge the spacings between the reed wires by providing a tapered member retractably on the yarn passing device 110** and inserting the tapered member between the reed wires.

With the arrangement of the device for automatically mending warp yarns according to the present invention, it is possible to position the yarn passing device with a high speed and a high accuracy inasmuch as the yarn passing device is positioned on a predetermined condition after the warp yarns adjoining the broken warp yarn are moved to thereby enlarge and detect the spacings of the reed wires through which the broken yarn is to be passed again or the adjoining reed wires. In the case where a plurality of warp yarns are passed through one of the reed wires, it is possible directly enlarge the spacings of the reed wires through which the warp yarn is passed so that the warp yarn, after mending the broken warp yarn, can be passed with ease. In the case where the warp yarn is broken, it is possible to specify the warp yarn which is passed through the same reed wires through which the broken warp yarn is passed by only detecting the identification code of the member through which the broken warp yarn is passed without detecting directly the warp yarn.

SECOND EMBODIMENT (FIGS. 14 to 26)

A method of automatically mending warp yarn and a device for carrying out the same according to a second embodiment of the present invention will be described with reference to FIGS. 14 to 26.

The elements which are the same as those in the first embodiment are given the same numerals and an explanation thereof has been omitted.

Figure 14:
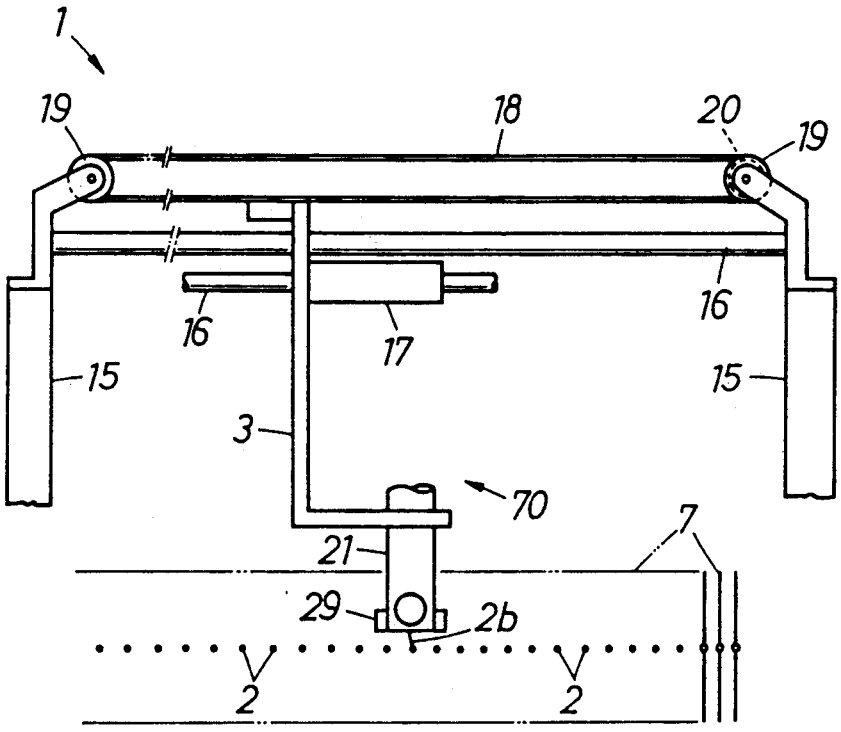
FIG. 14 is a front elevational view showing an automatic warp yarn mending device according to second embodiment of the present invention.
Figure 15:
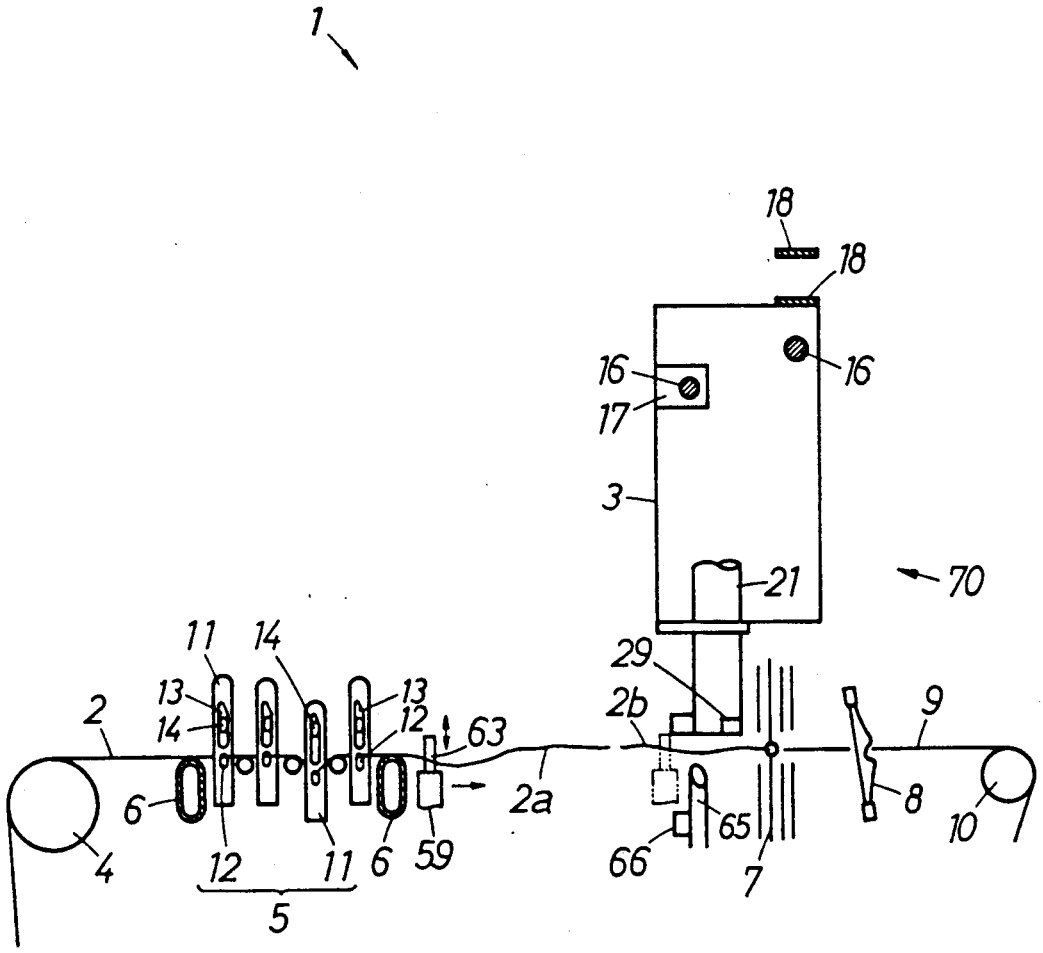
FIG. 15 is a side elevational view of the automatic warp yarn mending device of FIG. 14.

FIGS. 14 and 15 show an overall arrangement of an automatic warp yarn mending device 1.

Figure 20:
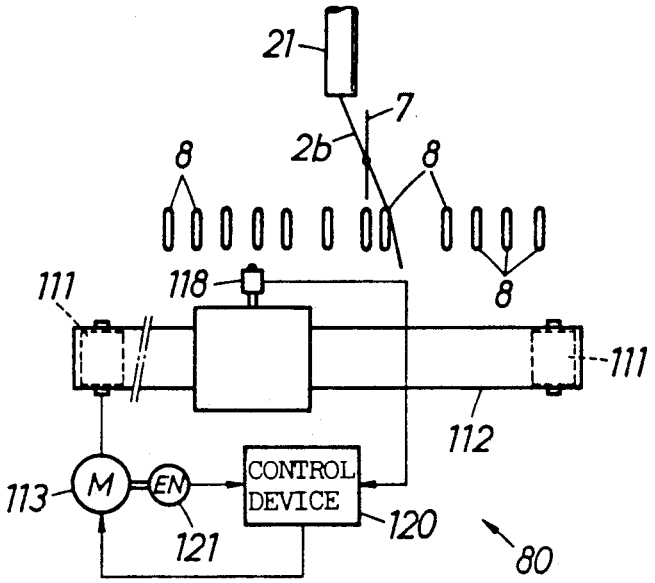
FIG. 20 is a plan view of a sensor driving means.

The automatic warp yarn mending device 1 is positioned over sheet-shaped warp yarns 2 and provided with a broken warp yarn moving device 70 and a detecting device 80 as illustrated in FIG. 20.

A plurality of warp yarns 2 contact the let-off tension roller 4, the guide bar 6 of the dropper device 5, pass through the heddle 7, reed wires of the reed 8, cross the weft yarns to be formed as the woven fabric 9, and reach the take-up roller 10. The droppers 11 of the dropper device 5 are supported by the warp yarns 2 at the portion of the through hole 12 and cross the electrode bar 14 at the portion of the holding hole 13.

The broken warp yarn moving device 70 is incorporated in the bracket 3. The bracket 3 is positioned between a left frame 15 and a right frame 16 and supported by a slider 17 movably in the direction of the width relative to the two guide rails 16 which extend widthwise of the loom in parallel with each other in order to hold the suction pipe 21 as the extraction member. The bracket 3 is connected to a part of an endless drive belt 18. The endless drive belt 18 is entrained around a pair of pulleys 19 which are supported by the left and the right side frames 15, 16 and capable of being driven by a position control motor 20. The guide rails 16, the slider 17, the drive belt 18 and the motor 20 constitute a drive means of the suction pipe 21.

Figure 18:
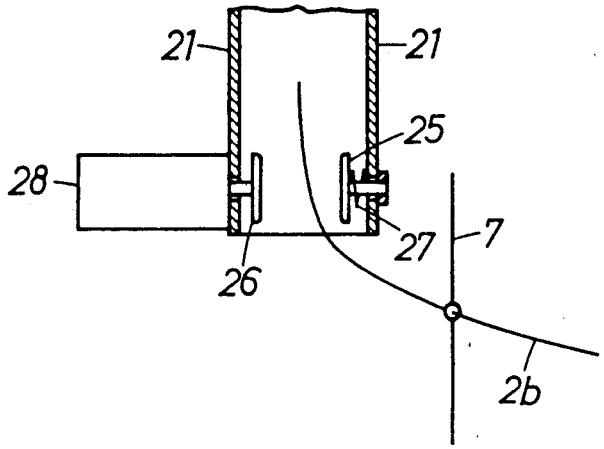
FIGS. 18 and 19 are cross-sectional views of suction members.
Figure 19:
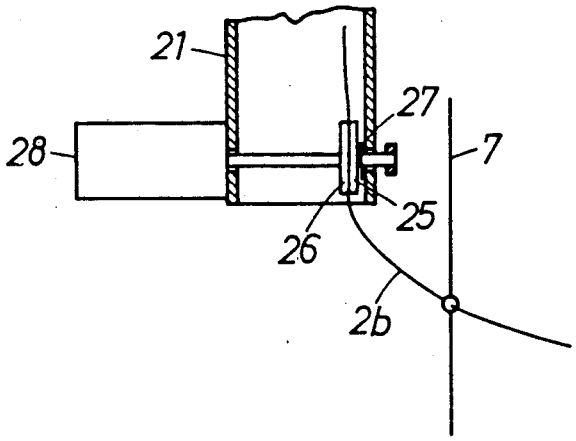

The suction pipe 21 is pipe-shaped and attached to the bracket 3 at the position higher than the droppers 11. The suction pipe 21 has an opening opened downward and the yarn sensor 29 of the light emitting and receiving type and a pair of clampers 25, 26 respectively provided at the opening thereof. As illustrated in FIGS. 18 and 19, one clamper 25 is retractably supported by a spring 27 and the other clamper 26 is supported to be movable toward and away from the clamper 25.

Figure 16:
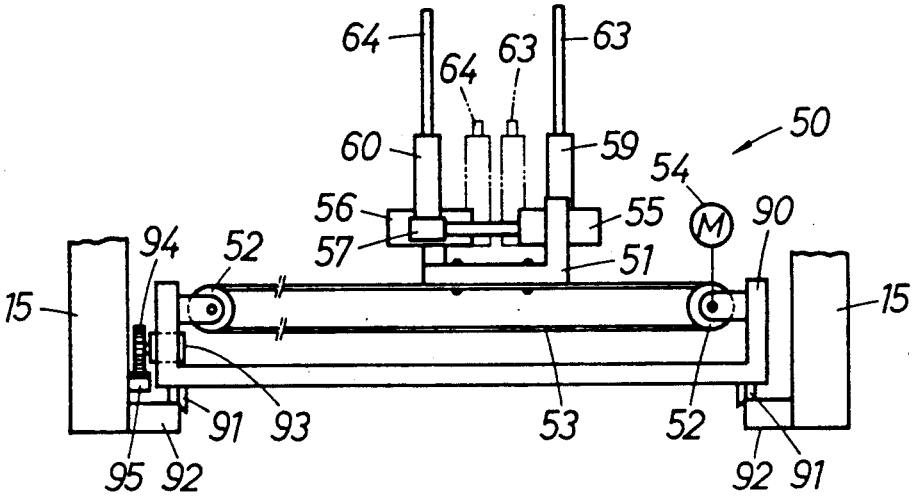
FIG. 16 is a front elevational view showing a heddle selecting device.
Figure 17:
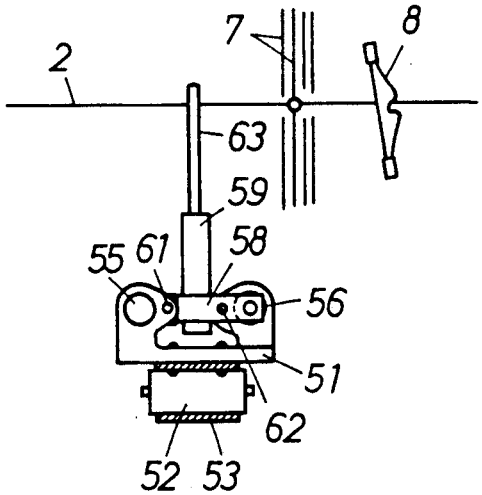
FIG. 17 is a side elevational view showing a main portion of the heddle selecting device.

FIGS. 16 and 17 illustrate an arrangement of a heddle selecting device 50.

The heddle selecting device 50 is positioned between the heddle 7 and the dropper device 5 under the warp yarn 2 and movable in the direction of the warp yarn 2 and width direction of the loom and incorporated in a bracket 51. The bracket 51 is supported on an endless belt 53 and movable in the width direction of the loom by a pair of pulleys 52 supported by brackets 90, the endless belt 53 entrained around the pulleys 52, and a drive motor 54 for rotating the pulley 52 at the drive side. The bracket 51 has horizontal pneumatic cylinders 55, 56 at the both ends of the widthwise direction of the loom which respectively hold holders 57, 58 at the tip ends thereof movable in the widthwise direction of the loom. The holders 57, 58 are guided by guide rods 61, 62 attached to the bracket 51 and supported so that the holders 57, 58 are not rotatable about the cylinder rods of the pneumatic cylinders 55, 56. The holders 57, 58 hold the selecting members 63, 64 which are vertically movable by the piston rods of vertically arranged pneumatic cylinders 59, 60. The bracket 90 is movable in the direction of the warp yarn 2 by left and right wheels 91 which are movable on rails 92 attached to the frames 15, a motor 93 attached to the bracket 90, a pinion 94 to be driven by the motor 93, and a rack 95 attached to the frames 15.

FIG. 20 shows an arrangement of the detecting device 80. The detecting device 80 is supported to be movable in the direction of the width of the loom by a belt 112 entrained around a pair of pulleys 111 which is rotatably attached to the frames 15 in the same manner as the heddle selecting device 50. The detecting device 80 is moved for a predetermined interval by the rotation of the motor 113 and is stopped upon reception of a signal issued by the sensor 118 indicative of the reed wires having large spacings and opposed to the reed 8. The motor 113 is controlled by a control device 120 and a speed of rotation of the motor 113 is detected by an encoder 121. The belt 112, the motor 113 and the control device 120, etc. constitute a drive means of the sensor 118.

Figure 21:
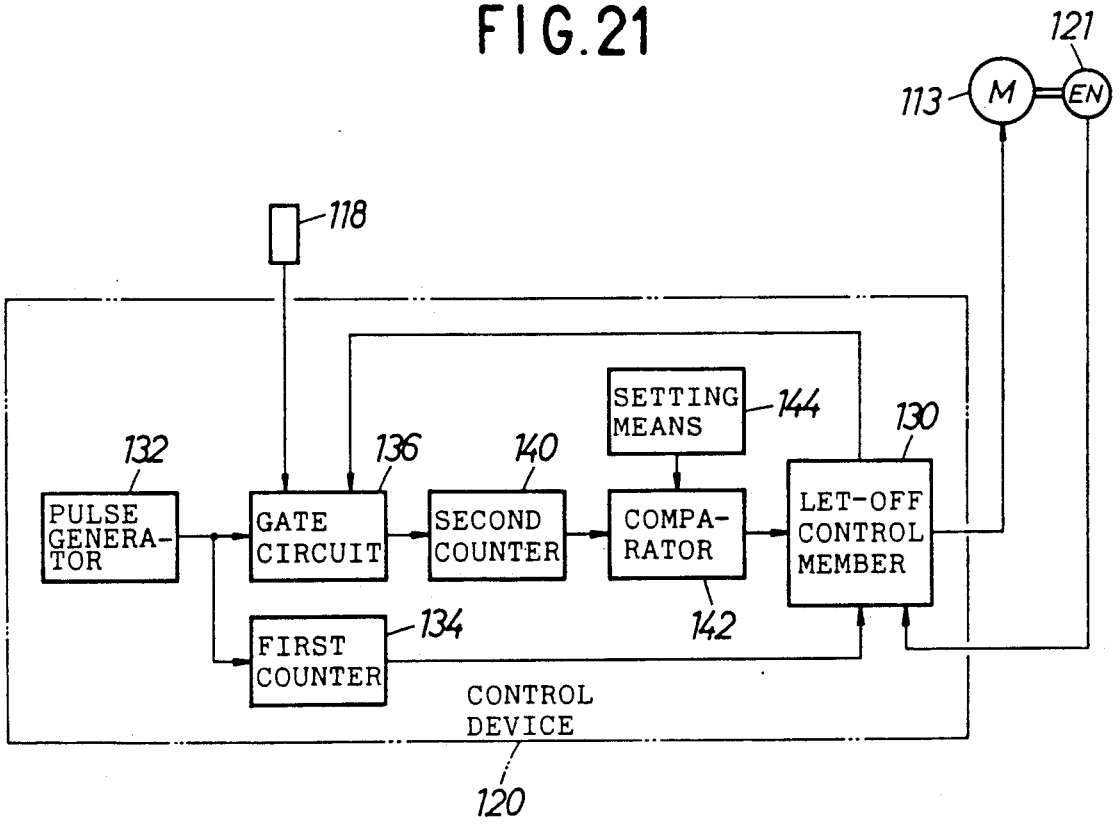
FIG. 21 is a block diagram of assistance in explaining a control device.

FIG. 21 shows an arrangement of the control device 120. The control device 120 comprises the let-off control member 130, the pulse generator 132, the first counter 134, the gate circuit 136, the second counter 140, the comparator 142 and the setting means 144. The control device 120 is connected to the sensor 118 at the gate circuit 136 via the control unit 170 and to the motor 113 and the encoder 121 at the input and output side of the let-off control member 130.

Figure 22:
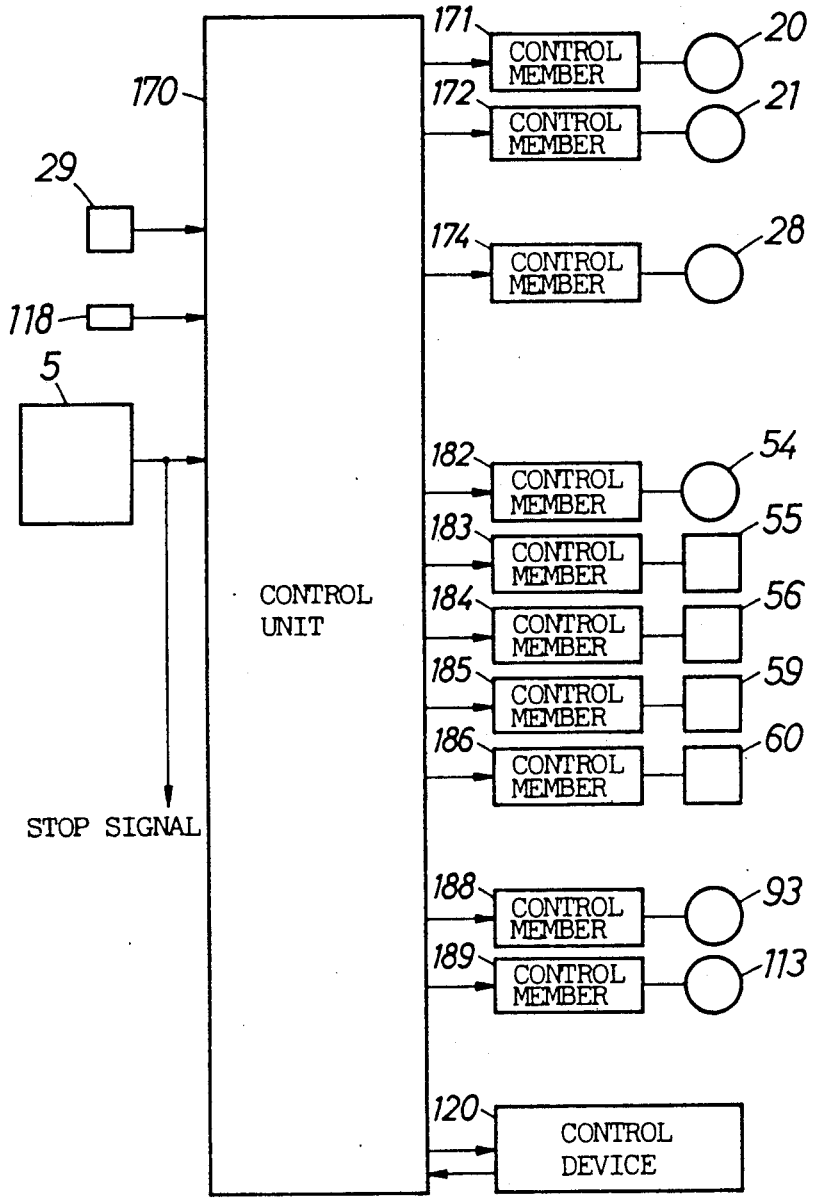
FIG. 22 is a block diagram of assistance in explaining the connecting relation between a control device and other operation members.

FIG. 22 shows a block diagram of assistance in explaining an electrical connecting relationship between the control unit 170 and other operation members. The control unit 170 is provided with a program to carry out the predetermined operation according to the second embodiment of the present invention. The control unit 170 is connected to the dropper device 5, the yarn sensors 29, 118 at the input side thereof, and to control members 171, 172, 174, 182, 183, 184, 185, 186, 188, 189 for controlling the position control motor 20, the suction member 21, the solenoid 28, the pneumatic cylinders 55, 56, 59, 60, the motors 93, 113 at the output side thereof. The control members 171, 172, 174, 182, 183, 184, 185, 186, 188, 189 are assembled, depending on the object to be controlled, as members to control the speed of rotation of the motors, turn on or off a source of the air under pressure or switches thereof or turn on or off the solenoid.

Figure 23:
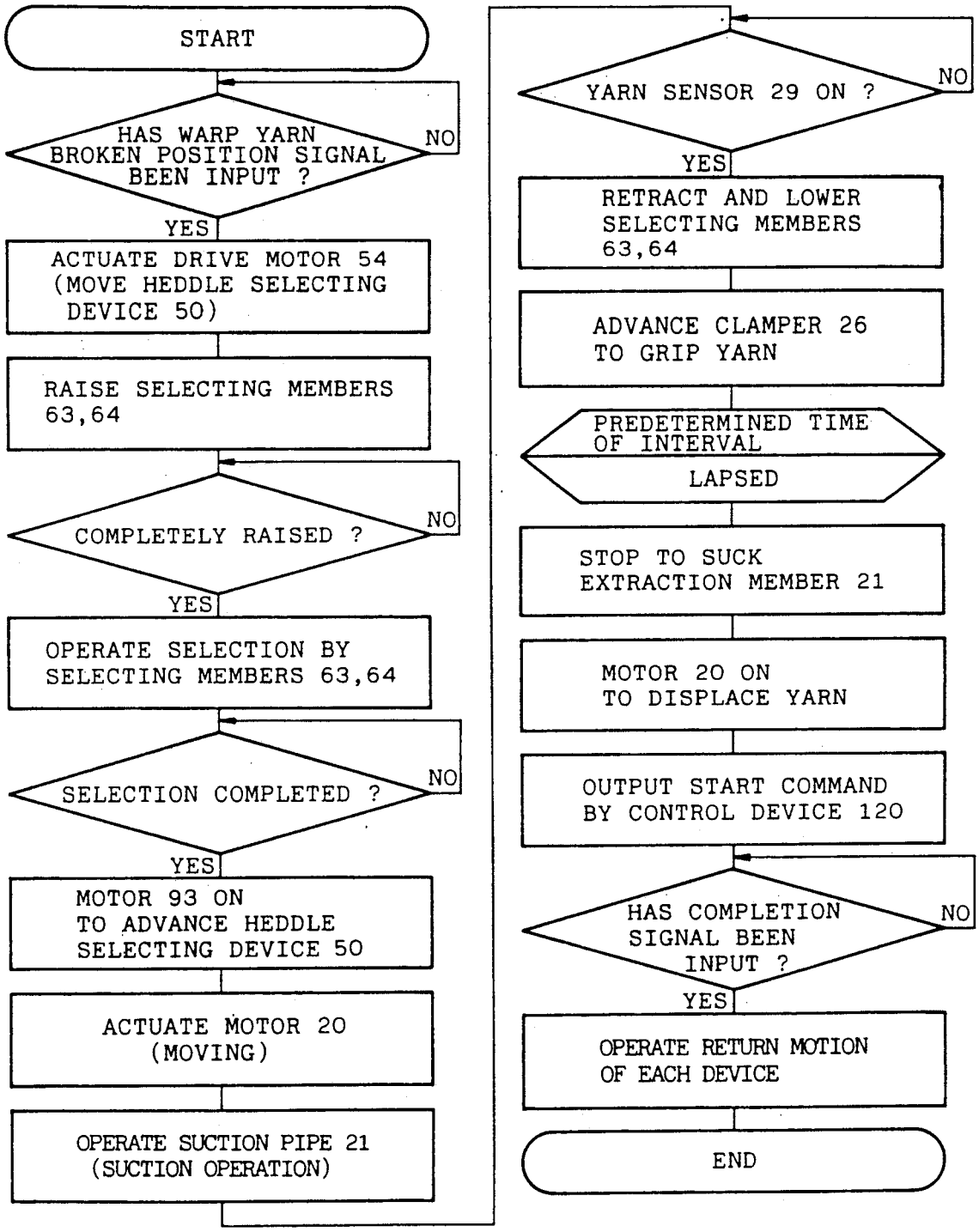
FIG. 23 is a flowchart showing a series of processes for automatically mending warp yarn.

FIG. 23 shows a series of control procedures to be executed by the control unit 170.

When the warp yarn 2 is broken during the weaving operation, the dropper 11 at the position corresponding to the broken warp yarns 2*a*, 2*b* are dropped and contact the electrode 14 whereby the dropper device 5 outputs an electrical warp yarn stop signal and supplies the warp yarn stop signal to the control system of the loom and at the same time outputs a position signal of the broken warp yarns 2*a*, 2*b* in the width direction of the loom and supplies the position signal to the control unit 170.

When the loom is stopped, an automatic warp yarn end picking device as disclosed in Japanese Laid-Open Patent Publication No. 62-69851 automatically detects the position of the dropper 11 which is dropped while it is moved, thereafter advances and retracts the dropper 11 in the widthwise direction of the loom while it is gripped. Then, the device displaces the normal warp yarn 2 adjacent to the broken warp yarns 2*a*, 2*b* in the direction of the picking end side for thereby forming spaces at the portions of the broken warp yarns 2*a*, 2*b* and sets the broken warp yarn 2 in order to be extracted with ease.

At the time when the control unit 170 receives the setting completion signal, the control unit 170 operates the drive motor 54 by the control member 182 to thereby move the heddle selecting device 50 to the position of the dropper 11 at the dropping state. Thereafter, the selecting members 63, 64 are raised between the two warp yarns adjoining the left and the right of the broken warp yarns 2a, 2b by the operations of control members 185, 186 and the pneumatic cylinders 59, 60. Inasmuch as two warp yarns 2 adjoining at the right and left sides of the previously broken warp yarns 2a, 2b are moved away from each other and displaced, the selecting members 63, 64 can be inserted between the two broken warp yarns 2a, 2b and between the right and left adjoining warp yarns 2. After completion of the raising operation, the selecting members 63, 64 at the raising state are moved away from each other by control members 183, 184 and the pneumatic cylinders 55, 56.

Figure 24:
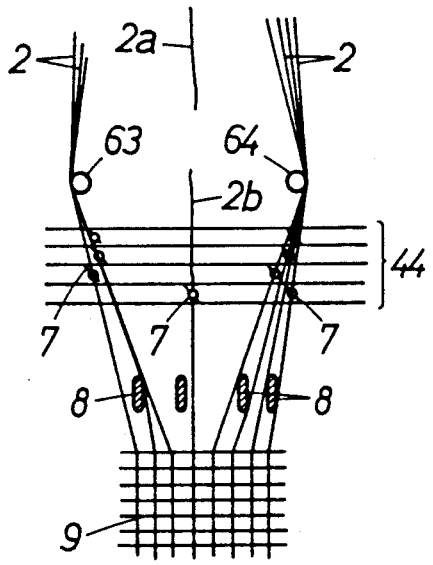
FIG. 24 is a plan view of assistance in explaining an operation for selecting the heddle.

After completion of the selecting operation, the control unit 170 rotates the pinion 94 by the control member 188 and the drive motor 93 to thereby advance the heddle selecting device 50 toward the take-up side whereby the dropper 11, the heddle 7 inserting the normal warp yarns 2 are moved away from the broken warp yarns 2a, 2b as illustrated in FIG. 24 and form spaces so that the end of the broken warp yarn 2b is extracted with ease. Thereafter, the control member 171 operates the motor 20 for controlling the speed of rotation thereof for thereby moving the bracket 3 from the stand-by position at the picking end side to the position of the widthwise direction of the loom corresponding to the droppers 11 at the dropping state whereby the opening of the suction pipe 21 faces the end of the broken warp yarn 2b at the portion adjacent to the heddle 7. Thereafter, the control member 172 is turned on to generate the air current inside the suction pipe 21 so that the suction pipe 21 carries out the drawing operation. The leading end of the broken warp yarn 2b is inserted into the suction pipe 21 by the drawing operation as illustrated in FIG. 5 and detected by the yarn sensor 29 which outputs a signal to the control unit 170 as the signal to proceed to the next step.

At this time, the control unit 170 retracts the selecting members 63, 64 in the direction of the width of the loom by operating the control members 183, 184 and the pneumatic cylinders 55, 56 and thereafter lowers selecting members 63, 64 by operating the control members 185, 186 and the pneumatic cylinders 59, 60. Furthermore, the solenoid 28 is operated by the control member 174 for clamping and holding the broken warp yarn 2b between the pair of clampers 25, 26 as illustrated in FIG. 19. After the passage of an appropriate time interval, the control unit 170 stops the drawing operation by the suction pipe 21, then rotates the motor 20 in a predetermined rotary direction and speed of rotation for moving the suction pipe 21 in the direction of the width of the loom whereby the tension of the broken warp yarn is increased and the spacings increased between the reed wires of the reed 8 through which the broken warp yarn 2b is passed.

The control unit 170, upon completion of the moving operation of the suction pipe 21, outputs a start instruction to the control device 120. The control device 120, upon receipt of the start instruction, at first turns on the motor 113 to thereby move the detecting device 80 from the reference position to the widthwise direction at a relatively high speed. At this time, the control member 130 successively receives the pulse signal indicative of the speed of the rotation of the motor 113 output by the pulse generator 132 through the first counter 134. When the value counted by the first counter 134 reaches a predetermined value corresponding to the position slightly before the broken warp yarn position, the let-off control member 130 outputs an "H" level signal to the gate circuit 136 for thereby setting the motor 113 to rotate at a low speed. Thereafter, the gate circuit 136 is turned on at the trailing edge of the detected signal output when the sensor 118 passes through the first reed and turned off at the leading edge of the detected signal output when the sensor 118 comes to the adjoining reed wires whereby the reference pulse output by the pulse generator 132 is supplied to the second counter 140 during the period. Thereafter the second counter 140 counts the number of reference pulse to thereby measure the spacings of the reed wires and output the measured value to the comparator 142. Then, the second counter 140 measures successively the spacings of the adjoining reed wires each time the sensor 118 passes through the reed wires and outputs the measured value to the comparator 142. Hence, the comparator 142 compares the measured value with the reference value set by the setting means 144 each time the comparator 142 receives the measured value. When the measured value exceeds the reference value, the comparator 142 outputs an "H" level signal to the let-off control member 130. The let-off control member 130, upon reception of the "H" level signal from the comparator 142, stores the value counted by the first counter 134, namely, the speed of rotation of the motor 113 for thereby stopping the motor 113. Thereafter, the let-off control member 130 transfers the counted value, namely, the speed of rotation of the motor 113, to the control unit 70. The control device 120 thus detects the reed wires having the large spacings therebetween to thereby identify the reed wires through which the broken warp yarns 2a, 2b passed with a high speed and a high accuracy. The control device 120, upon completion of the identification of the position, sends the position detection completion signal back to the control unit 170. The control unit 170 then returns all the operation members to the stand-by position and completes a series of operations.

Although the detecting device according to the second embodiment directly measures the spacings between the reed wires to thereby detect the reed wires having large spacings, it is not limited thereto.

Although the reference value is set previously by the setting means 144, the reference value may be the value obtained by measuring the spacings of the normal reed wires before passing the reed wires having large spacings.

The arrangement of the second embodiment is structured to detect the reed wires of the reed 8 having a large spacings but it may detect the spacings of the reed wires of the reed 8 having small spacings. For example, the broken warp yarn 2b is moved in the leftward direction in FIG. 20 and thereafter the sensor 118 is moved from the right end of the same figure to the left. Then the motor 113 is stopped to rotate upon detection of the reed wires having small spacings. The detected value minus the reference value from the detected speed of the rotation of the motor 113 corresponds to the position of the reed wires through which the broken warp yarn is passed. On the other hand, in the case where the broken warp yarn 2b is moved to the right in the same figure, the value added to the reference value to the detected speed of rotation of the motor 113 corresponds to the speed of rotation corresponding to the position of the reed wires through which the broken warp yarn 2b is passed. That is, whether to add the reference value to or deduct the reference value is determined from the detected speed of rotation relative to the moving direction of the broken warp yarn.

Figure 25:
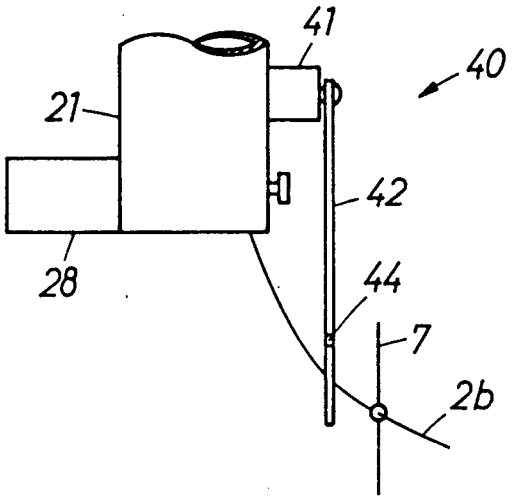
FIGS. 25 and 26 are side elevational views showing engaging members.
Figure 26:
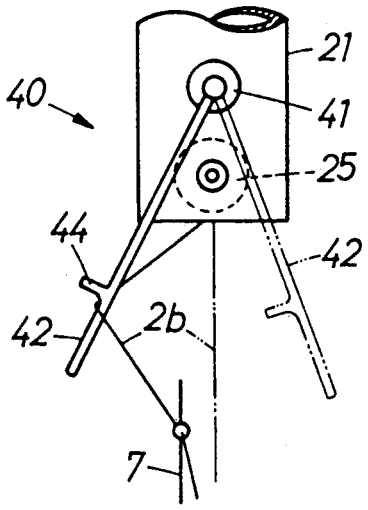

The member for moving the broken warp yarn comprises, according to the second embodiment, the pair of the clampers 25, 26 and the motor 20 for moving the entire suction pipe 21, but it may comprise an engaging member 40 provided on the suction pipe 21 which is driven to displace the broken warp yarn 2b. The engaging member 40 comprises a motor 41 and a lever 42. As illustrated in FIGS. 25 and 26, there is provided the motor 41 at the front portion of the take-up side of the suction pipe 21 and the lever 42 on the rotary shaft of the motor 41. The hook 44 is formed at the middle portion of the lever 42.

When the broken warp yarn 2b is extracted and held by the pair of clampers 25, 26 according to the second embodiment, the motor 41 is operated to move the lever 42 at the stand-by position as illustrated in FIG. 25. The lever 42 engages the broken warp yarn 2b between the suction pipe 21 and the heddle 7 with the movement thereof and displaces the broken warp yarn 2b to the position as illustrated in FIG. 26 while the broken warp yarn 2b is hooked by the hook 44. With such an operation of the engaging member 40, the spacings of the reed wires through which the broken warp yarn 2b is passed are enlarged.

The suction pipe 21 is provided between the dropper device 5 and the heddle 7 according to the second embodiment, but it may be provided between the heddle 7 and the reed 8. Furthermore, when the warp yarn 2 is broken between the reed 8 and the cloth fell, the broken warp yarn 2b passed through the reed 8 at the front of the reed, namely, at the take-up side is extracted and moved. Thereafter, the yarn passing device 110 which is stand-by at the reference position is moved in response to the signal output by the let-off control member 130 whereby the yarn passing device 110 is correctly positioned between the reed wires through which the broken warp yarns 2a, 2b are passed, and thereafter carries out the yarn passing operation in the same manner as the first embodiment.

The arrangement of the device for automatically mending the warp yarn according to the second embodiment is structured to extract the leading end of the broken warp yarn passed through the reed, to move the extracted broken warp yarn in the direction of width of the loom while it is fed whereby the spacings between the reed wires through which the broken warp yarn is passed are enlarged, which is detected by the sensor. Accordingly, it is possible to automate the detection of the broken warp yarn in the direction of the width of the loom with ease and high accuracy.

Although the invention has been described in its preferred form with a certain degree of particularity, it is to be understood that many variations and changes are possible in the invention without departing from the scope thereof.

What is claimed is:

1. A method of automatically mending warp yarn in a loom comprising the steps of:

extracting a broken warp yarn at the side of a reed through which the broken warp yarn is passed by a passing means when the warp yarn is broken;

enlarging a space between reed wires of the reed by moving the broken warp yarn in the direction of the width of the loom by a predetermined amount;

detecting the enlarged space between adjacent reed wires;

positioning a yarn passing needle provided with a hook in front of the reed relative to the reed wires of the reed through which the broken warp yarns are passed in accordance with the detected enlarged space between adjacent reed wires;

drawing and holding a mending yarn having a length which sufficiently reaches a cloth fell by a suction pipe at the rear of a heddle and at the position corresponding to the broken warp yarns; and passing the yarn passing needle provided with the hook through the space between the adjacent reed wires of the reed and a through hole of the heddle so that the mending yarn is thereby hooked and is passed toward the front of the cloth fell.

2. A device for automatically mending warp yarn in a loom comprising:

a broken warp yarn moving device composed of a knotter for tying a broken warp yarn to a mending yarn;

a holding means for holding an end of the mending yarn at a yarn passing position;

a suction pipe for extracting a broken warp yarn at the side of a reed through which the broken warp yarn is passed by a passing means and a moving means for holding the broken warp yarn and for moving the broken warp yarn in the direction of the width of the loom for a predetermined amount;

a detecting device composed of a sensor for detecting the space between the adjacent reed wires and a drive means for moving the sensor and a yarn passing device in the direction of the width of the loom, said yarn passing device including means for receiving an output of the sensor, and for inserting a yarn passing needle provided with a hook into a through hole of a heddle corresponding to the broken warp yarn based on detected adjacent reed wires having an enlarged space therebetween after said yarn passing device has been caused to stop moving in the direction of the width of the loom in response to the sensor output, and for thereafter passing the end of the mending yarn through the through hole of the heddle and the enlarged space between the adjacent reed wires of the reed;

wherein the broken warp yarn at the side of the reed through which the broken warp yarn is passed is extracted by the suction pipe when the warp yarn is broken, and is moved in the direction of the width of the loom for the predetermined amount while being held by the moving means whereby the enlarged space between the adjacent reed wires from said extraction is detected by the drive means of the detecting device in the direction of the width of the loom, and the yarn passing needle provided with the hook is inserted into a through hole of the heddle corresponding to the broken warp yarn from the enlarged space between the adjacent reed wires, and thereafter, the end of the mending yarn is passed into the through hole of the heddle and the enlarged space between the adjacent reed wires of the reed.

* * * * *